US007556555B2

(12) United States Patent
Feng et al.

(10) Patent No.: US 7,556,555 B2
(45) Date of Patent: Jul. 7, 2009

(54) POLISHING PAD, USE THEREOF AND METHOD FOR MANUFACTURING THE SAME

(75) Inventors: Chung-Chih Feng, Kaohsiung (TW); I-Peng Yao, Kaohsiung (TW); Lyang-Gung Wang, Kaohsiung (TW); Yung-Chang Hung, Kaohsiung (TW)

(73) Assignee: San Fang Chemical Industry Co., Ltd., Kaohsiung (TW)

( * ) Notice: Subject to any disclaimer, the term of this patent is extended or adjusted under 35 U.S.C. 154(b) by 18 days.

(21) Appl. No.: 11/706,189

(22) Filed: Feb. 15, 2007

(65) Prior Publication Data

US 2008/0200102 A1 Aug. 21, 2008

(51) Int. Cl.
*B24B 7/22* (2006.01)
*B24D 3/28* (2006.01)

(52) U.S. Cl. ..... 451/41; 451/533; 51/298

(58) Field of Classification Search ..... 451/533, 451/534, 532, 526, 536, 41; 51/297, 298
See application file for complete search history.

(56) References Cited

U.S. PATENT DOCUMENTS

| | | | | |
|---|---|---|---|---|
| 6,095,902 | A * | 8/2000 | Reinhardt | 451/36 |
| 6,623,337 | B2 * | 9/2003 | Scott et al. | 451/41 |
| 6,905,402 | B2 * | 6/2005 | Allison et al. | 451/533 |
| 2006/0089095 | A1 * | 4/2006 | Swisher et al. | 451/533 |

* cited by examiner

*Primary Examiner*—Robert Rose
(74) *Attorney, Agent, or Firm*—Sughrue Mion, PLLC

(57) ABSTRACT

The present invention mainly relates to a polishing pad comprising a base material comprising fibers; a membrane with low permeability; and a buffer layer formed between the base material and an upper surface of the membrane with low permeability and embedded into the fibers of the base material. A method of polishing a substrate comprising using the polishing pad and a method for manufacturing the polishing pad as described above are also provided.

19 Claims, 2 Drawing Sheets

POLISHING PAD, USE THEREOF AND METHOD FOR MANUFACTURING THE SAME

BACKGROUND OF THE INVENTION

1. Field of the Invention

The present invention relates to a polishing pad for use in chemical mechanical polishing.

2. Description of the Related Art

Chemical mechanical polishing (CMP) is a procedure for planarizing the surface of a substrate with a polishing pad. CMP is generally applied in polishing lens, mirrors, substrates of liquid crystal displays, silicon wafers, and oxidation and/or metal layers on silicon wafers.

Taking silicon wafers as an example, ingots of monocrystalline silicon are sliced first. The wafers are usually lapped to make them flat for subsequently chemical etching. A polishing process is required after the etching process. During the polishing process, a polishing pad together with slurry reacts chemically with the silicon atoms on the surface of the wafer to make the reacted surface softer than the underlying silicon. Furthermore, the reacted surface is continually wiped away causing fresh silicon to be exposed to the slurry and the polishing pad.

A conventional polishing pad comprises a base material comprising fibers. A polishing layer comprising porous elastomer such as polyurethane is also provided on or in the base material. By using pressure sensitive adhesive (PSA), the conventional polishing pads are secured to a polishing platen or head of a polishing machine. The pressure sensitive adhesive comprises a carrier film comprising polyester, for example, and has adhesive with a low fluidity on an upper side and a lower side of the carrier film, such adhesive being known as dual-sided adhesive. The adhesive on the upper side of the carrier film is configured to couple the base material of the polishing pad, and that on the lower side of the carrier film is to couple the polishing platen or head of the polishing machine.

Because the base material of the polishing pad comprises fibers, the content of the base material is not distributed evenly. The variations in the thickness of the base material are easily observed. Besides, the surface of the base material is not flat and is usually rough and undulant. Such features make the base material difficult to attach tightly and completely to the adhesive on the upper surface of the carry film of the pressure sensitive adhesive. Bubbles and vacant space are easily observed in an interface between the base material and the pressure sensitive adhesive. As a result, the slurrycan easily permeate into the interface between the base material and the pressure sensitive adhesive via the bubbles and vacant space. Therefore, the life span of the polishing pad is shortened. Additionally, when the polishing pad is replaced, residues of the pressure sensitive adhesive are easily left behind on the polishing platen or head and the residues of the pressure sensitive adhesive need to be removed and the duration of the time necessary for replacing polishing pad is lengthened. The effect and efficiency of chemical mechanical polishing are both reduced thereby.

SUMMARY OF THE INVENTION

One object of the present invention is to provide a polishing pad comprising:

a base material comprising fibers;

a membrane with low permeability, the membrane having an upper surface; and a buffer layer formed between the base material and the upper surface of the membrane with low permeability and embedded into the fibers of the base material.

Another object of the present invention is to provide a method of polishing a substrate comprising using the polishing pad as described above to polish a surface of the substrate.

Still another object of the present invention is to provide a method for manufacturing the polishing pad according to claim 1 comprising steps of:

(a) providing the base material;

(b) impregnating the base material with a buffer layer solution and forming the buffer layer; and (c) applying the membrane with low permeability to the buffer layer.

DETAILED DESCRIPTION OF THE INVENTION

Figure 1:
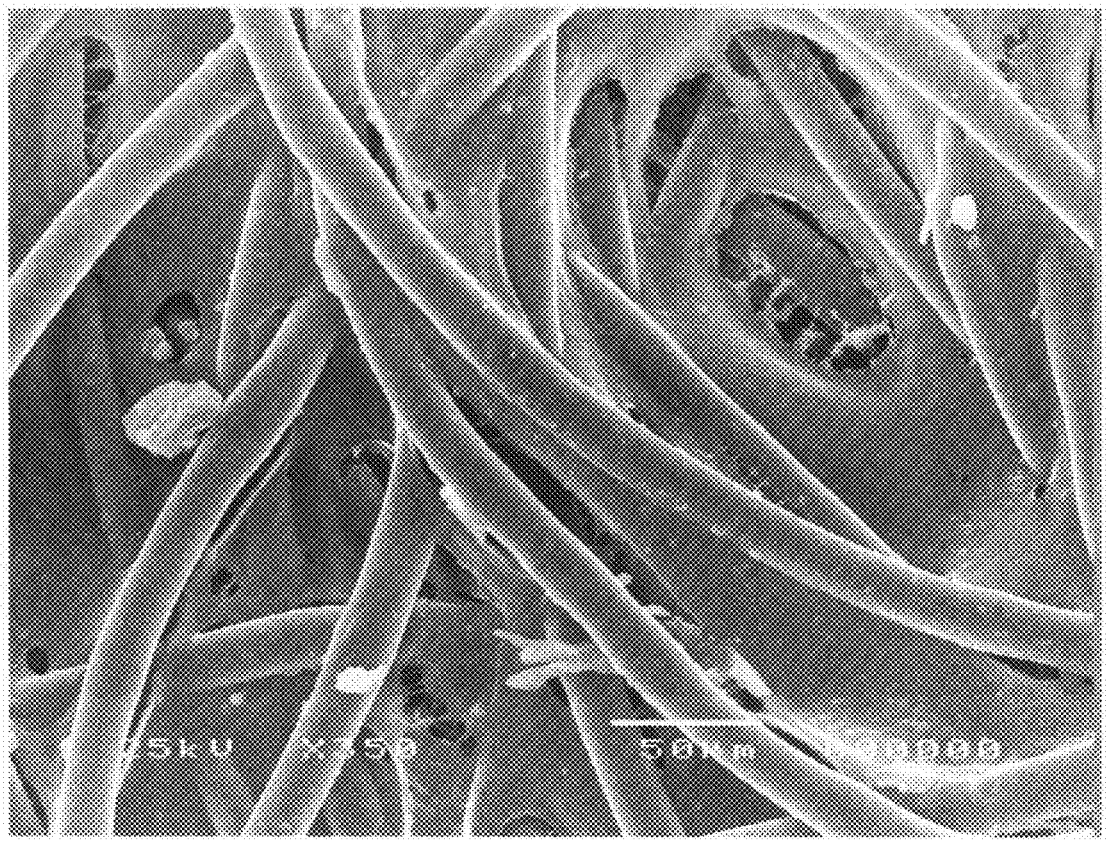
FIG. 1 (Prior Art)
FIG. 1 illustrates a view under a transmission electron microscope of the paste layer of the Comparative Example.

The present invention is to provide a polishing pad comprising:

a base material comprising fibers;

a membrane with low permeability; and a buffer layer formed between the base material and an upper surface of the membrane with low permeability and embedded into the fibers of the base material.

According to the invention, any base material comprising fibers can be applied in the invention. Preferably, the base material is a non-woven fabric, and more preferably, the base material is a rolled non-woven fabric. The rolled nonwoven fabric can be used in a roll to roll way that improves batch uniformity in comparison with a conventional method of producing a single polishing pad involving molding or casting.

As used herein, "non-woven fabric" refers to a manufactured sheet, web or mat of directionally or randomly orientated fibers, bonded by friction, and/or cohesion and/or adhesion, excluding paper and products which are woven, knitted, tufted, stitch-bonded incorporating binding yarns or filaments, or felted by wet-milling, whether or not additionally needled. The fibers may be of natural or man-made origin. They may be staple or continuous filaments or be formed in situ. Depending on the method of forming the web, the nonwoven fabric usually comprises a composite nonwoven fabric, a needle-punched nonwoven fabric, a melt-blown nonwoven fabric, a spunbonded nonwoven fabric, a dry-laid nonwoven fabric, a wet-laid nonwoven fabric, a stitch bonded nonwoven fabric, or a spunlace nonwoven fabric. Compared with woven fabric, non-woven fabric has a better material property.

As used herein, the term "fiber" refers to a single fiber or composite fibers, preferably composite fibers. The fiber is selected in accordance with the substrate to be polished. The fibers of the surface of the base material provide protrusions for polishing and also provide a scaffold allowing elastomers of a polishing layer to be deposed in the space defined by the scaffold. Artisans skilled in this field can choose suitable kinds of fibers and coordinate the elastomer polymer with the fibers according to the disclosure of the specification. Preferably, the long fiber is made of at least one material selected from the group consisting of polyamide, terephthalamide, polyester, polymethyl methacrylate, polyethylene terephthalate, polyacrylonitrile, and mixtures thereof.

As used herein, the term "a membrane with low permeability" refers to a membrane or film that substantially prevents the buffer layer on the upper surface of the membrane with low permeability according to the invention from permeating to the lower surface of the membrane with low permeability. Preferably, the material of the membrane with low permeability is selected from the group consisting of polyethylene terephthalate (PET), polypropylene (PP), polycarbonate (PC), and polyethylene (PE). Furthermore, the polypropylene is oriented polypropylene (OPP).

The buffer layer according to the invention is formed between the base material and the upper surface of the membrane with low permeability and embedded into the fibers of the base material. Because the buffer layer according to the invention is embedded into the fibers of the base material, it serves as an intermediate between the base material and the membrane with low permeability. The buffer layer according to the invention is designed to modify the surface of the base material, and is able to fill rough and undulant points of the base material. Therefore, the membrane with low permeability can be positioned on a flat surface of the buffer layer. No bubbles and vacant space are observed in the polishing pad according to the invention. Moreover, the polishing pad according to the invention adheres to the polishing platen or head tightly and completely without slurry permeating. The life span of the polishing pad is lengthened and the polishing pad is easily replaced. Furthermore, the buffer layer according to the invention provides a buffer for eliminating the damage to the polishing pad when polishing. The effect and efficiency of chemical mechanical polishing are both improved thereby.

In one preferred embodiment of the invention, the buffer layer is paste. The paste replaces the adhesive on the upper side of the carrier film in the conventional polishing pad for adhering directly to the membrane with low permeability. Preferably, the paste has a viscosity between 1 to 30,000 cps. In order to fill the rough and undulant points of the base material, the paste is preferably fluid paste. For example, the paste may comprise polyurethane or polyether.

In one preferred embodiment of the invention, the paste is two-component paste. The two-component paste refers to paste comprising two components that interact or cross-link with each other for achieving the adherence effect. Preferably, the two-component paste comprises a polyol resin and polyisocyanate. More preferably, the polyol resin is polyurethane or polyether.

In one preferred embodiment of the invention, the polishing pad further comprises a paste layer formed on a lower surface of the membrane with low permeability. More preferably, the paste layer is pressure sensitive adhesive or polyurethane. As used herein, the "pressure sensitive adhesive" comprises a carrier film and adhesive on an upper side and a lower side of the carrier film. Preferably, the material of the carrier film is selected from the group consisting of polyethylene terephthalate, polypropylene and polyethylene.

In another preferred embodiment of the invention, the polishing pad further comprises a polishing layer comprising porous elastomer. As used herein, the term "elastomer," also known as "elastic polymer," refers to a type of polymer that exhibits rubber-like qualities. When polishing, the elastomer serves as a good buffer to avoid scraping the surface of the substrate to be polished. In one preferred embodiment of the invention, the elastomers are foam resins. As used herein, the term "foam resin" refers to a material containing a thermoplastic resin and a thermodecomposing foaming agent. Preferably, the elastomers include at least one selected from the group consisting of polyamide, polycarbonate, polyaminonitrile, polymethacrylate, epoxyl resin, phenolic resins, polymethyl methacrylate, polyaminoester, vinylbenzene polymer, acrylic resin, and polyurethane. More preferably, the elastomer is polyurethane.

The present invention also provides a method of polishing a substrate comprising using the polishing pad as mentioned above to polish a surface of the substrate.

The present invention also provides a method for manufacturing the polishing pad as described above comprising steps of:

(a) providing the base material;

(b) impregnating the base material with a buffer layer solution and forming the buffer layer; and (c) applying the membrane with low permeability to the buffer layer.

The following Examples are given for the purpose of illustration only and are not intended to limit the scope of the present invention.

COMPARATIVE EXAMPLE

Impregnating: Non-woven fabric of base material was impregnated in an elastomer solution with polyurethane.

Curing: The base material, after impregnating, was put into a curing solution comprising 25 wt % dimethylformamide in water to mold the elastomer impregnated in the fibers.

Washing: The residues and the excess curing solution were removed by extrusion wheels. The base material was then washed in water and then subjected to the extrusion wheels several times.

Drying: The base material, after washing, was then dried.

Publishing: After drying, the base material was subjected to mechanical polishing to obtain a base material with a suitable thickness.

Paste layer: Dual-sided pressure sensitive adhesive (BA313) was then applied on the membrane with low permeability. A photograph of the paste layer under the transmission electron microscope is shown in FIG. 1.

Adhesive strength: The adhesive strength is between 0.1 and 0.3 kg/cm.

EXAMPLE

Impregnating: Non-woven fabric of base material was impregnated in an elastomer solution with polyurethane.

Curing: The base material, after impregnating, was put into a curing solution comprising 25 wt % dimethylformamide in water to mold the elastomer impregnated in the fibers.

Washing: The residues and the excess curing solution were removed by extrusion wheels. The base material was then washed in water and then subjected to the extrusion wheels several times.

Drying: The base material, after washing, was then dried.

Publishing: After drying, the base material was subjected to mechanical polishing to obtain a base material with a suitable thickness.

Buffer layer: The polishing pad was impregnated with two-component paste (BA313).

Membrane with low permeability: A polyethylene terephthalate film is applied on the buffer layer to form the membrane with low permeability.

Figure 2:
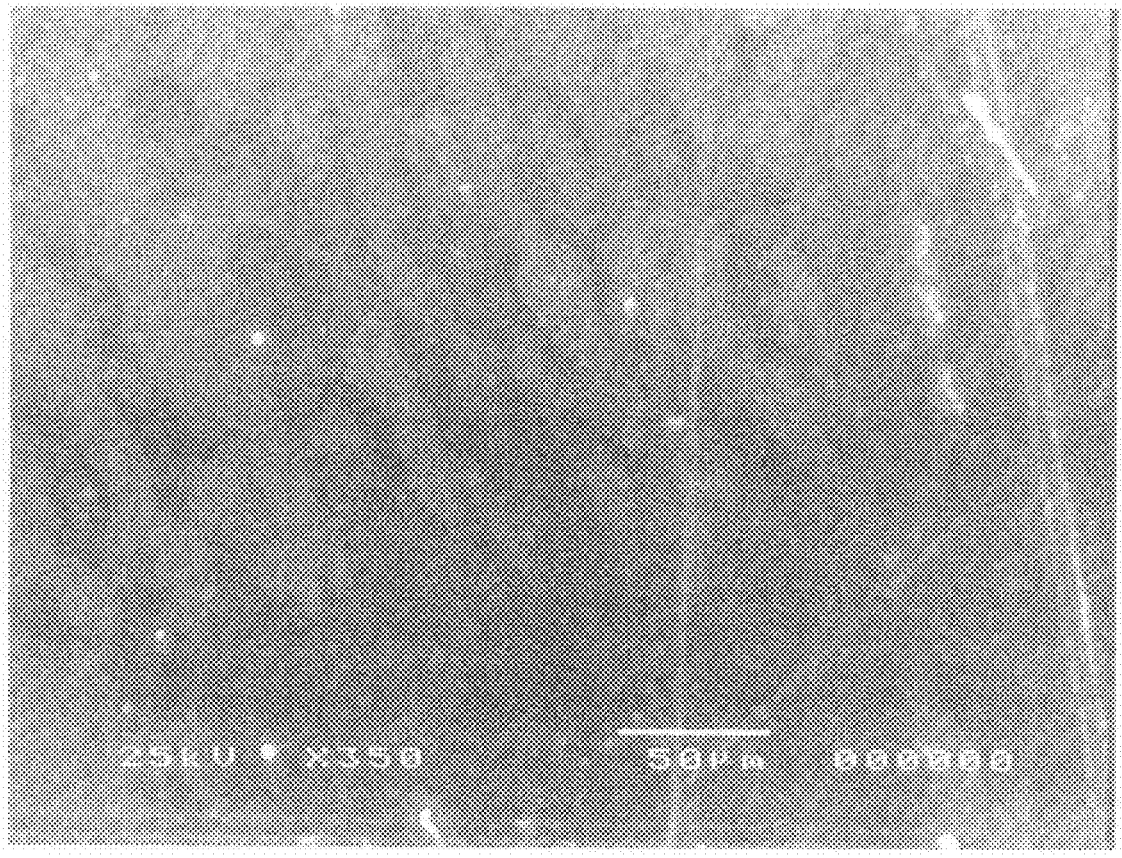
FIG. 2 illustrates a view under a transmission electron microscope of the paste layer of the Example.

Paste layer: Dual-sided pressure sensitive adhesive (BA313) was then applied on the membrane with low permeability. A photograph of the paste layer under the transmission electron microscope is shown in FIG. 2.

Adhesive strength: The adhesive strength is more than 0.6 kg/cm.

While embodiments of the present invention have been illustrated and described, various modifications and improvements can be made by persons skilled in the art. The embodiments of the present invention are therefore described in an illustrative but not restrictive sense. It is intended that the present invention is not limited to the particular forms as illustrated, and that all the modifications not departing from the spirit and scope of the present invention are within the scope as defined in the appended claims.

What is claimed is:

1. A polishing pad comprising:

a base material comprising fibers;

a membrane with low permeability, the membrane having an upper surface; and a buffer layer formed between the base material and the upper surface of the membrane with low permeability; wherein the buffer layer is embedded into the fibers of the base material to modify the surface of the base material and fill rough and undulant points of the base material, and the buffer layer is a paste.

2. The polishing pad according to claim 1, wherein the material of the membrane with low permeability is selected from the group consisting of polyethylene terephthalate (PET), polypropylene (PP), polycarbonate (PC), and polyethylene (PE).

3. The polishing pad according to claim 2, wherein the polypropylene is oriented polypropylene (OPP).

4. The polishing pad according to claim 1, wherein the paste has a viscosity between 1 to 30,000 cps.

5. The polishing pad according to claim 1, wherein the paste is a fluid paste.

6. The polishing pad according to claim 1, wherein the paste is two-component paste.

7. The polishing pad according to claim 6, wherein the two-component paste comprises a polyol resin and polyisocyanate.

8. The polishing pad according to claim 7, wherein the polyol resin is polyurethane or polyether.

9. The polishing pad according to claim 1, wherein the paste comprises polyurethane or polyether.

10. The polishing pad according to claim 1 further comprising a paste layer formed on a lower surface of the membrane with low permeability.

11. The polishing pad according to claim 10, wherein the paste layer is pressure sensitive adhesive (PSA) or polyurethane.

12. The polishing pad according to claim 11, wherein the pressure sensitive adhesive comprises a carrier film and adhesive on an upper side and a lower side of the carrier film.

13. The polishing pad according to claim 12, wherein the material of the carrier film is selected from the group consisting of polyethylene terephthalate, polypropylene and polyethylene.

14. The polishing pad according to claim 1 further comprising a polishing layer comprising porous elastomer.

15. The polishing pad according to claim 14, wherein the elastomer is polyurethane.

16. A method of polishing a substrate comprising using the polishing pad according to claim 1 to polish a surface of the substrate.

17. A method for manufacturing the polishing pad according to claim 1 comprising steps of:

(a) providing the base material;

(b) impregnating the base material with a buffer layer solution and forming the buffer layer; and (c) applying the membrane with low permeability to the buffer layer.

18. The method according to claim 17 further comprising step (d) of forming a paste layer on a lower surface of the membrane with low permeability.

19. The method according to claim 18, wherein the paste layer is pressure sensitive adhesive (PSA) or polyurethane.

* * * * *